US008208648B2

(12) United States Patent
Yoshino et al.

(10) Patent No.: US 8,208,648 B2
(45) Date of Patent: Jun. 26, 2012

(54) SOUND FIELD REPRODUCING DEVICE AND SOUND FIELD REPRODUCING METHOD

(75) Inventors: Hajime Yoshino, Edogawa (JP); Akira Hattori, Yokohama (JP)

(73) Assignee: Pioneer Corporation, Tokyo (JP)

( * ) Notice: Subject to any disclaimer, the term of this patent is extended or adjusted under 35 U.S.C. 154(b) by 244 days.

(21) Appl. No.: 12/530,442

(22) PCT Filed: Mar. 9, 2007

(86) PCT No.: PCT/JP2007/054707

§ 371 (c)(1),
(2), (4) Date: Dec. 17, 2009

(87) PCT Pub. No.: WO2008/111143

PCT Pub. Date: Sep. 18, 2008

(65) Prior Publication Data

US 2010/0092002 A1 Apr. 15, 2010

(51) Int. Cl.
*H03G 3/00* (2006.01)

(52) U.S. Cl. ..... 381/63; 381/61.2; 381/93; 381/17; 381/18; 381/97; 84/630; 84/649; 84/650; 84/609; 84/610

(58) Field of Classification Search ..... 381/63, 381/61.2, 93, 17, 18, 97, 98, 89; 84/630, 84/649–650, 609–610, 615–616, 600–603
See application file for complete search history.

(56) References Cited

U.S. PATENT DOCUMENTS 4,739,513 A * 4/1988 Kunugi et al. ..... 381/103
5,040,219 A * 8/1991 Ando et al. ..... 381/61
5,572,591 A * 11/1996 Numazu et al. ..... 381/1
5,604,810 A * 2/1997 Yanagawa ..... 381/63
6,901,148 B2 * 5/2005 Yoshino et al. ..... 381/103
6,909,041 B2 * 6/2005 Ohta ..... 84/630
6,977,653 B1 12/2005 Cleary et al.
7,194,084 B2 * 3/2007 Shaffer et al. ..... 379/420.01
7,211,959 B1 * 5/2007 Chou ..... 315/149
8,041,046 B2 * 10/2011 Ohta et al. ..... 381/66

(Continued)

FOREIGN PATENT DOCUMENTS

JP 57-115099 7/1982

(Continued)

OTHER PUBLICATIONS

Kurozumi et al, The Relationship between the Cross-Correlation Coeffcient of Two -Channel acoustic Signals and Sound Image Quality.*

(Continued)

*Primary Examiner* — Davetta W Goins
*Assistant Examiner* — Kuassi Ganmavo
(74) *Attorney, Agent, or Firm* — Young & Thompson

(57) ABSTRACT

The sound field reproducing apparatus includes: a signal obtaining unit which obtains input audio signals of plural channels; an effect adding unit which gives an effect on an output to a sound field; and an effect amount control unit which controls an amount of the effect based on a characteristic of the input audio signal. The sound field reproducing apparatus receives input audio signals of plural channels from a medium such as a DVD, and gives a sound effect to them to output. The amount of the effect given to the input audio signal is controlled based on the characteristic of the input audio signal, especially the cross correlation of the reverberation component between the channels.

10 Claims, 4 Drawing Sheets

U.S. PATENT DOCUMENTS

2003/0121403 A1* 7/2003 Miyagishima et al. ..... 84/735

FOREIGN PATENT DOCUMENTS

| | | | |
|---|---|---|---|
| JP | 57-138695 | | 8/1982 |
| JP | 02-122797 | | 5/1990 |
| JP | 05-153698 | | 6/1993 |
| JP | 05-153698 | A * | 6/1993 |
| JP | 07-229788 | A * | 8/1995 |
| JP | 2001-100756 | | 4/2001 |
| JP | 2001-268698 | | 9/2001 |
| JP | 2003-091293 | | 3/2003 |
| JP | 2003099093 | A * | 4/2003 |
| JP | 2004-295039 | | 10/2004 |

OTHER PUBLICATIONS

International Search Report/ PCT/JP2007/054707, May 22, 2007.

* cited by examiner

SOUND FIELD REPRODUCING DEVICE AND SOUND FIELD REPRODUCING METHOD

TECHNICAL FIELD

The present invention relates to a sound field reproducing apparatus which reproduces a sound field characteristic in an audio system including a plurality of speakers.

BACKGROUND TECHNIQUE

A multi-channel surround audio system popular these days has 5 to 8 channels, for example, and also includes an amplifier device which controls the audio outputs of those channels and speakers of numbers corresponding to the number of the channels. In order to realize the surround reproduction, it is necessary to position each speaker at an appropriate position and to set the sound pressure level and frequency characteristic of the audio signal to be adapted to the characteristic of each speaker. Therefore, the amplifier device of the surround audio system generally includes an equalizer and an amplifier for each channel.

Also, in order to reproduce a sound field with presence, there has been proposed a method of using reverberation sound of the input signal. For example, in the Patent Reference-1, the reverberation sound signal is generated based on the acoustic signal and the position information of the listener, and the reverberation sound is synthesized with the original signal to be reproduced.

Patent Reference-1: Japanese Patent Application Laid-open under No. 2003-91293

DISCLOSURE OF INVENTION

Problem to be Solved by the Invention

By the method described in the Patent Reference-1, it is possible to reproduce the sound field that the listener intends in a virtual space with reality. However, in order to reproduce desired sound field, it is necessary for the listener to have expert knowledge of certain degree, like a contents producer.

The above is an example of problems to be solved by the present invention. It is an object of the present invention to provide a sound field reproducing apparatus capable of automatically adjusting the amount of effect to provide dynamic sound field, without making a listener conscious of it.

Means for Solving the Problem

The invention described in claim 1 is a sound field reproducing apparatus which includes: a signal obtaining unit which obtains input audio signals of plural channels; an effect adding unit which gives an effect on an output to a sound field; and an effect amount control unit which controls an amount of the effect based on a characteristic of the input audio signal.

The invention described in claim 9 is a sound field reproducing method which includes: a signal obtaining process which obtains input audio signals of plural channels; an effect adding process which gives an effect on an output to a sound field; and an effect amount control process which controls an amount of the effect based on a characteristic of the input audio signal.

BRIEF DESCRIPTION OF REFERENCE NUMBERS

Figure 1:
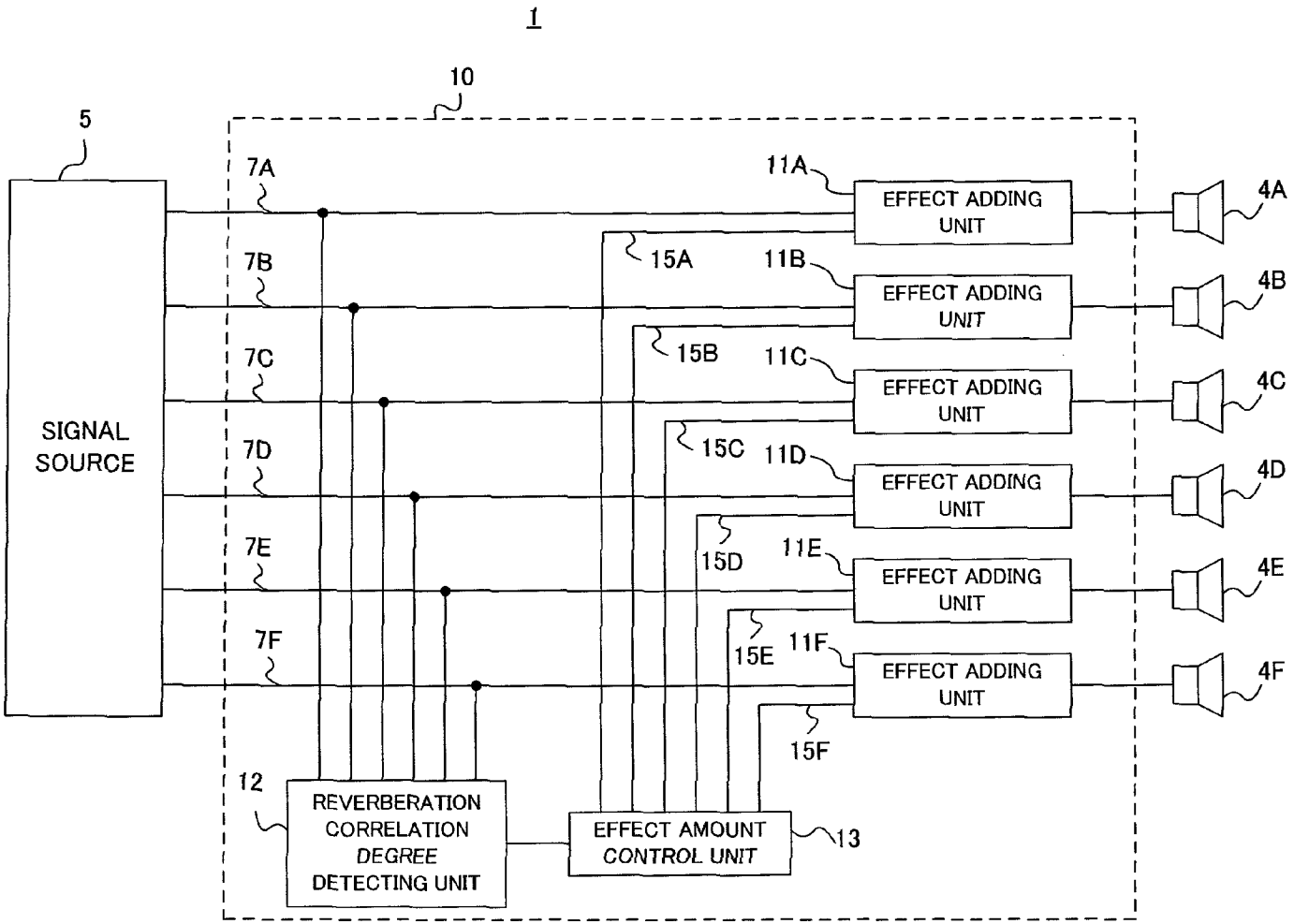
FIG. 1 is a schematic diagram of a multi-channel audio system to which a sound field reproducing apparatus according to the present invention is applied.

1 Multi-channel audio system
4 Speaker
5 Signal source
10 Amplifying device
11 Effect adding unit
12 Reverberation correlation degree detecting unit
13 Effect amount control unit

DETAILED DESCRIPTION OF THE PREFERRED EMBODIMENTS

According to one aspect of the present invention, there is provided a sound field reproducing apparatus comprising: a signal obtaining unit which obtains input audio signals of plural channels; an effect adding unit which gives an effect on an output to a sound field; and an effect amount control unit which controls an amount of the effect based on a characteristic of the input audio signal.

The above sound field reproducing apparatus receives the input audio signals of plural channels from a medium such as a DVD, and gives the effect on the output to the sound field based on the input audio signals. The amount of the effect given is controlled based on the characteristic of the input audio signal. Therefore, the effect can be effectively given in accordance with the audio signals included in the medium.

In one mode of the above sound field reproducing apparatus, the output to the sound field is a sound output, and the effect amount control unit controls the amount of the effect given to the input audio signal. In another mode, the output to the sound field is a light, and the effect amount control unit controls brightness and/or color of the light. In still another mode, the output to the sound field is a light of a display unit of an equipment located in the sound field, and the effect amount control unit controls brightness and/or color of the light.

In still another mode, the above sound field reproducing apparatus further comprises a correlation degree detecting unit which detects a correlation degree of reverberation component between the input audio signals, and the effect amount control unit controls the amount of the effect in accordance with the correlation degree of the reverberation component. In this mode, since the amount of the effect is controlled in accordance with the correlation of the reverberation component, dynamic space expression can be achieved in accordance with the scene of the contents recorded on the medium.

In a preferred example, the correlation degree detecting unit detects the correlation degree of the reverberation component between the reverberation component of the input audio signal of one of the plural channels, and the input audio signal of another one of the plural channels. The effect amount control unit controls the amount of the effect given to the input audio signal of another one of the plural channels, in accordance with the correlation degree of the reverberation component. Preferably, the correlation degree detecting unit calculates the correlation degree between a delay signal obtained by delaying the input audio signal of one of the plural channels, and the input audio signal of another one of the plural channels.

Further, in still another mode of the above sound field reproducing apparatus, the effect amount control unit increases the amount of the effect as the correlation degree is higher. By this, the space expression can be emphasized in accordance with the scene in the contents to be reproduced.

According to another aspect of the present invention, there is provided a sound field reproducing method comprising: a signal obtaining process which obtains input audio signals of plural channels; an effect adding process which gives an effect on an output to a sound field; and an effect amount control process which controls an amount of the effect based on a characteristic of the input audio signal. By this sound field reproducing method, the amount of the effect given to the output to the sound field is controlled based on the characteristic of the input audio signal. Therefore, the effect can be effectively given in accordance with the audio signals included in the medium.

A preferred mode of the above sound field reproducing method further comprises a correlation degree detecting process which detects a correlation degree of reverberation component between the input audio signals, and the effect amount control process controls the amount of the effect in accordance with the correlation degree of the reverberation component.

EMBODIMENT

A preferred embodiment of the present invention will be described below with reference to the attached drawings.

FIG. 1 is a block diagram showing a multi-channel audio system to which the present invention is applied. As shown, the multi-channel audio system (hereinafter simply referred to as "audio system") 1 includes a signal source 5, an amplifying device 10 and six speakers 4A to 4F.

The signal source 5 may be a DVD player, for example, and outputs multi-channel audio signals 7A to 7F. The amplifying device 10 adds sound effect (hereinafter simply referred to as "effect") to the input audio signals 7A to 7F and supplies them to each of the speakers 4A to 4F.

Specifically, the speakers 4A to 4F are a left-side front speaker 4A, a right-side front speaker 4B, a center speaker 4C, a sub-woofer 4D, a left-side rear speaker 4E and a right-side rear speaker 4F. By these speakers, the surround reproduction can be achieved.

The amplifying device 10 includes effect adding units 11A to 11F provided in correspondence with the plural channels, a reverberation correlation degree detecting unit 12 and an effect amount control unit 13.

The effect adding units 11A to 11F adds predetermined effect to the input audio signals 7A to 7F of corresponding channel, respectively. The examples of the effect include a reverberation effect which adds the reverberation component to the input audio signal, and a delay effect which delays the input audio signal. As the same reverberation effect, various kinds of reverberation effects can be achieved by changing the amount and/or timing of adding the reverberation component. Similarly, various kinds of delay effects can be achieved by changing the delay time.

The reverberation correlation degree detecting unit 12 detects a cross correlation degree of the reverberation component of the input audio signals (hereinafter referred to as "reverberation correlation degree"). The effect amount control unit 13 determines the effect amounts, which each of the effect adding units 11A to 11F adds, based on the reverberation correlation degree detected by the reverberation correlation degree detecting unit 12, and supplies the control signals 15A to 15F to each of the effect adding units 11A to 11F. Each of the effect adding units 11A to 11F adds the effect corresponding to the control signals 15A to 15F thus supplied to the input audio signals 7A to 7F.

Between the effect adding units 11A to 11F and the speakers 4A to 4F, D/A converters and/or amplifiers (not shown) may be provided.

Figure 2:
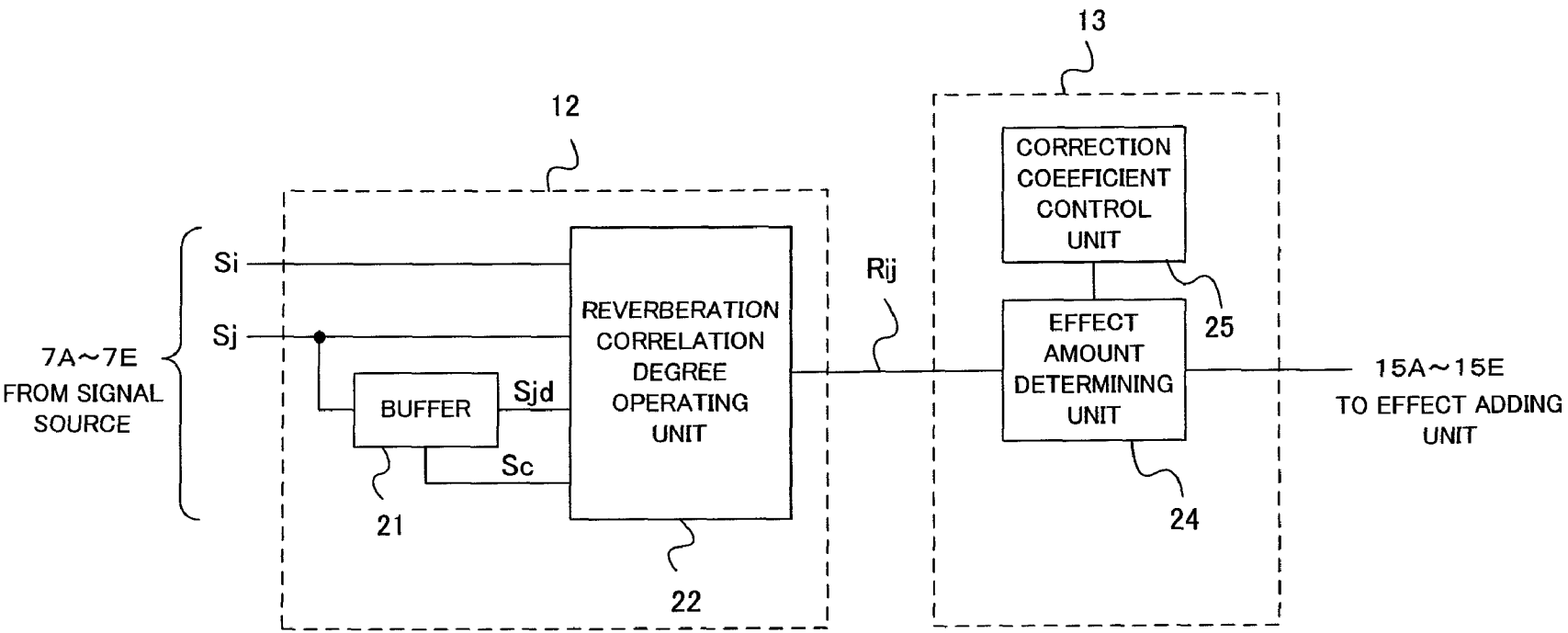
FIG. 2 is a block diagram showing a detail of a reverberation correlation degree detecting unit and an effect amount control unit shown in FIG. 1.

FIG. 2 shows the configuration of the reverberation correlation degree detecting unit 12 and the effect amount control unit 13. The reverberation correlation degree detecting unit 12 includes a buffer 21 and a reverberation correlation degree operating unit 22. Actually, the reverberation correlation degree detecting unit 12 may be formed by a DSP (Digital Signal Processor). For the convenience of the explanation, FIG. 2 only shows the components necessary to detect the reverberation correlation degree of 2-channel input audio signals. Therefore, in practice, plural buffers 21, whose number corresponds to the channel number of the input audio signals, are provided.

The reverberation correlation degree of the input audio signals is basically a correlation degree between the reverberation component of one signal and another signal. The component of one signal may be mixed into another signal at the time slightly later on the time axis. Therefore, the reverberation correlation degree can be obtained by calculating the correlation degree between the component of one signal delayed for a predetermined time by the buffer 21 and the component of another signal.

In this view, the reverberation correlation degrees of the input audio signals can be calculated for a number of a square of the channel number of the input audio signals. In this embodiment, since the input audio signals have 6 channels, 30 reverberation correlation degrees can be calculated. In this case, as to the combination of the input audio signals 7A and 7B, the reverberation correlation degree between the reverberation component of the input audio signal 7A and the input audio signal 7B is different from the reverberation correlation degree between the reverberation component of the input audio signal 7B and the input audio signal 7A.

In FIG. 2, out of the multi-channel input audio signals 7A to 7F, one signal is referred to as "the signal Si", and another signal is referred to as "the signal Sj". Here, the signal Si is the signal of the channel which receives the influence of the reverberation, and the signal Sj is the signal of the channel which gives the influence. Namely, the correlation degree between the delayed signal of the signal Sj and the signal Si is calculated on the assumption that the reverberation component of the signal Sj is mixed into the signal Si.

Specifically, in FIG. 2, the reverberation correlation degree operating unit 22 receives the signal Si and the signal Sjd produced by delaying the signal Sj for a predetermined time by the buffer 21, and calculates the correlation degree between those signals. Here, assuming that the signals Si and Sj are digital signals, that each sample of the signal Si is expressed by "x", that each sample of the signal Sj is expressed by "y", and that the delay time (delay sample number) of the buffer 21 is "m" samples, the reverberation correlation degree Rm is obtained by the following equation (1):

$$R_m = \sum_{i=1}^{n} \frac{(x_i - \overline{X})(y_{i+m} - \overline{Y})}{\sqrt{\sum (x_i - \overline{X})^2}\sqrt{\sum (y_{i+m} - \overline{Y})^2}} \quad (1)$$

$\overline{X}$, $\overline{Y}$: ARITHMETIC MEAN OF OBJECT RANGE

The value of the delay time "m" corresponds to the time necessary for the component of the signal Sj to be mixed to the signal Si as the reverberation component. However, the delay time in which the reverberation component of each signal is mixed to another signal is actually unknown, the reverberation correlation degree is calculated in this embodiment by changing the delay time "m" within a predetermined range. Specifically, in detecting the reverberation correlation degree, it is necessary to eliminate the component of a certain channel that is assigned to another channel, and/or the direct sound component. In this view, the delay time "m" can be the sample number corresponding to 5 msec., for example, as the start value "ms", and can be the sample number corresponding to the reverberation time in a normal space as the ending value "me".

Figure 3:
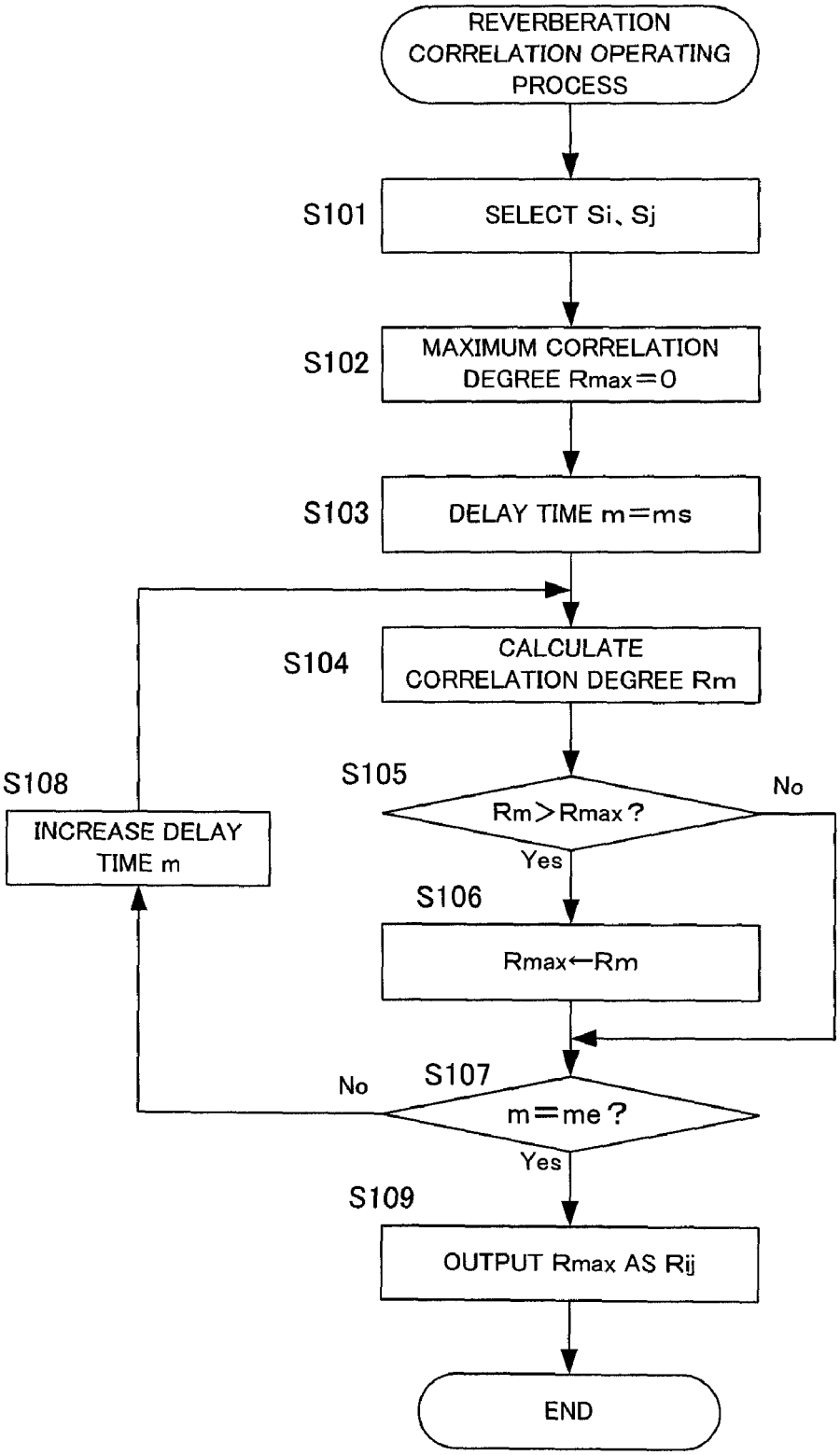
FIG. 3 is a flowchart showing reverberation correlation degree operating process.

FIG. 3 is a flowchart of the reverberation correlation degree operating process. This process is basically executed by the reverberation correlation degree operating unit 22.

First, from the multi-channel input audio signals, two signals, i.e., the signal Si and Sj are selected (step S101). Next, the maximum correlation degree Rmax, which is a variable indicating the maximum value of the reverberation correlation degree, is reset to "0" (step S102). Then, the delay time (delay sample number) "m" is set to the start value "ms" (step S103). By this, the delay sample number of the buffer 21 is set to "ms", and the reverberation correlation degree operating unit 22 calculates the correlation degree Rm between the signal Si and the signal Sjd obtained by delaying the signal Sj by "m" samples (step S104).

Next, the reverberation correlation degree operating unit 22 compares the obtained correlation degree Rm with the maximum correlation degree Rmax (step S105). If the reverberation correlation degree Rm is larger than the maximum correlation degree Rmax, the reverberation correlation degree operation unit 22 substitute the obtained correlation degree Rm for the maximum correlation degree Rmax (step S106), and the process goes to step S107.

Then, the reverberation correlation degree operating unit 22 determines whether or not the current delay sample number reaches the end value "me" (step S107). If the delay sample number reaches the end value "me", the process goes to step S109. On the other hand, if the delay sample number does not reach the end value "me", the reverberation correlation degree operating unit 22 supplies the control signal Sc to the buffer 21 to increase the delay sample number "m" in the buffer 21 (step S108), and repeats steps S104 to S107.

In this way, the reverberation correlation degree Rm is repeatedly calculated until the delay sample number "m" changes from the start value "ms" to the end value "me", and its maximum value is stored as the maximum correlation degree Rmax. Then, if the delay sample number "m" reaches the end value "me" (step S107), the maximum correlation degree Rmax at that time is outputted as the reverberation correlation degree Rij between the signals Si and Sj (step S109), and the process ends.

The above process is executed for all the combination of the multi-channel input audio signals. Namely, in this embodiment, 30 reverberation correlation degree Rij (i=A to F, j=A to F) are calculated for 6 channel input audio signals 7A to 7F, and are supplied to the effect amount control unit 13.

Next, the process in the effect amount control unit 13 will be described. As described above, 30 reverberation correlation degrees Rij (i=A to F, j=A to F) for 6 channel input audio signals 7A to 7F are supplied to the effect amount control unit 13. As shown in FIG. 2, the effect amount control unit 13 includes a correction coefficient storing unit 25 and an effect amount determining unit 24.

The effect amounts of the effect adding units 11A to 11F, before the effect amount control unit 13 changes, are determined in accordance with the user's setting, or the kind of the signal source, for example. In contrast, the effect amount control unit 13 corrects the effect amount in accordance with the reverberation correlation degree.

For example, when the reverberation correlation degree between one channel and another channel is low, the effect amount control unit 13 presumes that the scene has little reverberation due to the intention of the sound source producer or the recording environment, and decreases the effect amount such as the reverberation effect or the delay effect. On the other hand, if the reverberation correlation degree is high, the effect amount control unit 13 presumes that the scene has much reverberation, and increases the effect amount such as the reverberation effect or the delay effect to perform the representation emphasizing the space.

Figure 4A:
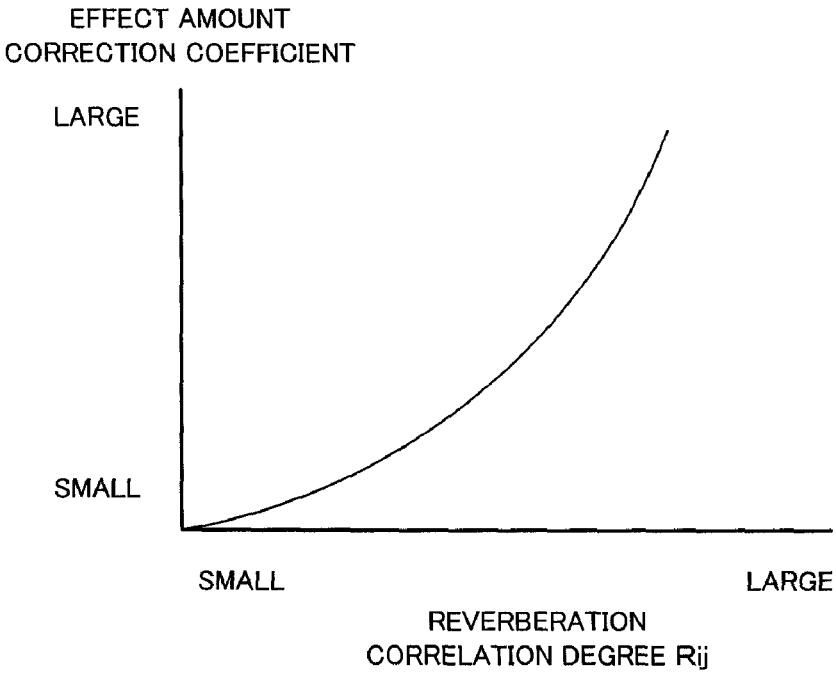
FIGS. 4A and 4B are examples showing the relation between the reverberation correlation degree and the effect amount correction coefficient.
Figure 4B:
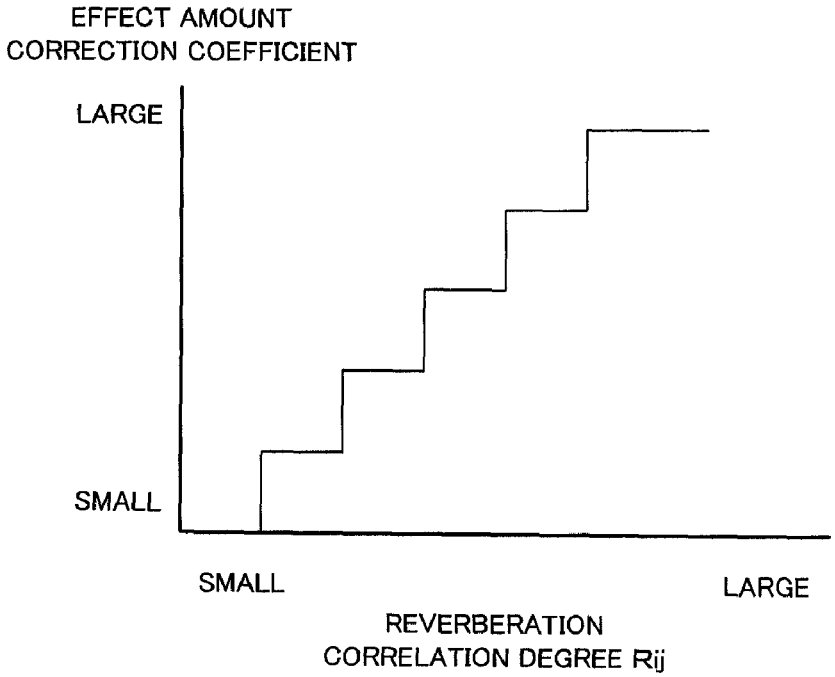

The correction coefficient storing unit 25 stores a correction coefficient table indicating the relationship between the reverberation correlation degree Rij and the effect amount correction coefficient. The examples of the correction coefficient table are shown in FIGS. 4A and 4B. In both examples shown in FIGS. 4A and 4B, the value of the correction coefficient increases, as the reverberation correlation degree Rij increases. Namely, as the mixture of the reverberation component of one channel to another channel increases, the effect amount is increases to emphasize the effect. Thereby, the sound field reproduction with presence becomes possible in accordance with the characteristic of the signal source. In the example of FIG. 4A, the effect amount correction coefficient continuously increases according to the increase of the reverberation correlation degree Rij. In the example of FIG. 4B, the effect amount correction coefficient increases stepwise according to the increase of the reverberation correlation degree Rij. It is noted that the above tables are merely examples, and the contents of the correction coefficient table is not limited to these examples.

In this embodiment, the reverberation correlation degree detecting unit 12 supplies 30 reverberation correlation degrees Rij to the effect amount control unit 13 in correspondence with 6 channel input audio signals. Therefore, basically the correction coefficient storing unit 25 stores 30 correction coefficient tables corresponding to them. However, in view of saving the memory capacity, one correction coefficient table may be commonly used for plural combinations of channels. Also, although the correction coefficients are stored as the table, the correction coefficients can be obtained by arithmetic operation instead.

The effect amount thus corrected based on the reverberation correlation degree Rij are supplied to the effect adding units 11A to 11F as the control signals 15A to 15F.

As described above, in this embodiment, since the correlation degree of the reverberation component between channels is detected from the audio signals included in a reproduction medium such as a DVD, and the effect amount applied to each channel is automatically adjusted by using the correlation degree as the parameter, dynamic space representation adapted to the contents of the signal source becomes possible.

Modified Examples

In the above embodiment, although the reverberation correlation degrees are detected for all the combination of the plural channels and used for the control of the effect amount, it may be limited to specific combination of the plural channels. For example, the reverberation correlation degree may be detected for the combination for which the correlation of the reverberation component is generally high. For example, only the influence of the reverberation component from the center channel to the front left and right channel, and only the influence of the reverberation component from the left and right channel to the surround channel may be reflected to the effect amount. By this, the effect can be effectively performed with reducing the burden of operating the reverberation correlation degree.

The correction degree of the effect amount may be different for each combination of the channels. For example, the larger correction coefficient may be set to the combination for which the correlation degree tends to be high, than other combinations, so that the increasing degree of the effect amount becomes large for the reverberation correlation degree of the similar level.

Further, the attention may be directed to the level of the input audio signal. For example, the channel having the level higher than a predetermined value at a certain timing is judged to be a superior channel which includes the direct sound, and the channel having the level lower than the predetermined level at the certain timing is judged to be an inferior channel which includes only the reverberation component. Then, the effect amount may be controlled by using only the reverberation correlation degree between the superior channel and the inferior channel. By this, the effect can be effectively performed at the respective timings with reducing the burden of operating the reverberation correlation degree.

In the above embodiment, the reverberation effect and the delay effect are cited as the effect. Alternatively or additionally, the light effect may be included, which varies the brightness and/or color of the room where the audio system 1 is located, or the brightness and/or color of the display unit of the amplifying device 10.

In the above embodiment, the reverberation correlation degree is cited as the base for controlling the effect amount. Alternatively, the effect amount may be controlled in accordance with other characteristic of the input audio signal, such as the distortion amount of the input audio signal or the level of the higher harmonic.

INDUSTRIAL APPLICABILITY

This invention can be used for various apparatuses or systems for reproducing multi-channel audio signals, such as a home theater product, an audio product and a sound facility in a movie theater.

The invention claimed is:

1. A sound field reproducing apparatus comprising:

a signal obtaining unit which obtains input audio signals of plural channels;

a correlation degree detecting unit which detects a correlation degree of reverberation component between the input audio signals;

an effect adding unit which gives an effect on an output to a sound field; and an effect amount control unit which controls an amount of the effect based on the correlation degree of reverberation component, wherein the correlation degree detecting unit calculates, while changing a delay time within a predetermined range, the correlation degree between a delay signal obtained by delaying the input audio signal of one of the plural channels by the delay time, and the input audio signal of another one of the plural channels, and determines a maximum value of the correlation degrees corresponding to each delay time changed within the range as the correlation degree of reverberation component.

2. The sound field reproducing apparatus according to claim 1, wherein the effect amount control unit increases the amount of the effect as the correlation degree is higher.

3. The sound field reproducing apparatus according to claim 1, wherein the output to the sound field is a sound output, and wherein the effect amount control unit controls the amount of the effect given to the input audio signal.

4. The sound field reproducing apparatus according to claim 3, wherein the correlation degree detecting unit detects the correlation degree of the reverberation component between the reverberation component of the input audio signal of one of the plural channels, and the input audio signal of another one of the plural channels, and wherein the effect amount control unit controls the amount of the effect given to the input audio signal of another one of the plural channels, in accordance with the correlation degree of the reverberation component.

5. The sound field reproducing apparatus according to claim 1, wherein the output to the sound field is a light, and wherein the effect amount control unit controls brightness and/or color of the light.

6. The sound field reproducing apparatus according to claim 1, wherein the output to the sound field is a light of a display unit of an equipment located in the sound field, and wherein the effect amount control unit controls brightness and/or color of the light.

7. A sound field reproducing method comprising:

a signal obtaining process which obtains input audio signals of plural channels;

a correlation degree detecting process which detects a correlation degree of reverberation component between the input audio signals;

an effect adding process which gives an effect on an output to a sound field; and an effect amount control process which controls an amount of the effect based on the correlation degree of reverberation component, wherein the correlation degree detecting process calculates, while changing a delay time within a predetermined range, the correlation degree between a delay signal obtained by delaying the input audio signal of one of the plural channels by the delay time, and the input audio signal of another one of the plural channels, and determines a maximum value of the correlation degrees corresponding to each delay time changed within the range as the correlation degree of reverberation component.

8. The sound field reproducing method according to claim 7, further comprising a correlation degree detecting process which detects a correlation degree of reverberation component between the input audio signals, wherein the effect amount control process controls the amount of the effect in accordance with the correlation degree of the reverberation component.

9. The sound field reproducing apparatus according to claim 1, wherein the predetermined range has a start value which is a delay time by which the input audio signal includes no direct sound component, and an end value which is a delay time corresponding to a reverberation time in a normal space.

10. The sound field reproducing method according to claim 7, wherein the predetermined range has a start value which is a delay time by which the input audio signal includes no direct sound component, and an end value which is a delay time corresponding to a reverberation time in a normal space.

* * * * *